US007047785B2

(12) United States Patent
Peruzzo et al.

(10) Patent No.: US 7,047,785 B2
(45) Date of Patent: May 23, 2006

(54) INSTALLATION FOR PROCESSING METAL BARS WITH IMPROVED MEANS FOR TRANSFERRING THE BARS, AND METHOD PROVIDED THEREBY

(75) Inventors: Lorenzo Peruzzo, Turin (IT); Stefano Peruzzo, Turin (IT)

(73) Assignee: OSCAM Spa, Turin (IT)

( * ) Notice: Subject to any disclaimer, the term of this patent is extended or adjusted under 35 U.S.C. 154(b) by 42 days.

(21) Appl. No.: 10/607,205

(22) Filed: Jun. 27, 2003

(65) Prior Publication Data

US 2004/0261485 A1 Dec. 30, 2004

(30) Foreign Application Priority Data

Jun. 28, 2002 (IT) ..... TO2002A0563
Feb. 27, 2003 (IT) ..... TO2003A0140

(51) Int. Cl.
*B21D 7/00* (2006.01)

(52) U.S. Cl. ..... 72/306; 72/422; 414/751.1

(58) Field of Classification Search ..... 72/306, 72/307, 422, 149; 414/751.1, 745.3, 561, 414/753.1, 749.4
See application file for complete search history.

(56) References Cited

U.S. PATENT DOCUMENTS

| | | | | |
|---|---|---|---|---|
| 3,431,759 | A * | 3/1969 | Whittingham et al. | 72/405.09 |
| 4,662,204 | A * | 5/1987 | Saegusa | 72/306 |
| 4,681,210 | A * | 7/1987 | Miki et al. | 198/468.2 |
| 4,684,312 | A * | 8/1987 | Antoszewski et al. | 414/735 |
| 5,006,036 | A * | 4/1991 | Massmann | 414/744.5 |
| 5,093,978 | A * | 3/1992 | Binder | 483/43 |
| 5,291,771 | A * | 3/1994 | Tomo et al. | 72/306 |
| 5,520,502 | A * | 5/1996 | Liljengren et al. | 414/751.1 |
| 6,694,794 | B1 * | 2/2004 | Crippa | 72/307 |

FOREIGN PATENT DOCUMENTS

| | | |
|---|---|---|
| EP | 0 419 441 A | 3/1991 |
| FR | 2 675 065 A | 10/1992 |
| WO | WO 01 91936 A | 12/2001 |

* cited by examiner

*Primary Examiner*—Daniel C. Crane
(74) *Attorney, Agent, or Firm*—Sughrue Mion, PLLC

(57) ABSTRACT

A transferring device usable in installations for cutting and/or bending metal bars, particularly bars intended for concrete reinforcement. The device comprises one or more gripping pliers movable along mutually orthogonal axes of an overhead traveling crane arrangement. Each set of pliers is carried by an articulated wrist.

25 Claims, 7 Drawing Sheets

INSTALLATION FOR PROCESSING METAL BARS WITH IMPROVED MEANS FOR TRANSFERRING THE BARS, AND METHOD PROVIDED THEREBY

BACKGROUND OF THE INVENTION

The present invention relates to installations for cutting and/or bending metal bars.

In particular, the invention relates to an installation for bending metal bars, particularly bars intended for concrete reinforcement, comprising the characteristics set out in the pre-characterising part of claim 1.

An installation of the aforesaid kind is described and illustrated in the document WO 01/91936. This known installation is provided with transfer means comprising a plurality of pliers of the type specified above, each of which is borne by a slide movable vertically on a carriage which in turn is able to translate along a respective raised cross member. The raised cross members carrying the various pliers are mounted in sliding fashion in the form of overhead travelling cranes on raised longitudinal beams of a fixed support frame. This arrangement is used to transfer bars bent in a bending station from said bending station to a station for collecting the bent bars.

The same arrangement instead is not used, or usable, to transfer the bars still to be bent from a station upstream of the bending station to the bending station. The reason for that limitation stems from the fact that the bars in the station upstream of the bending station are generally aligned in a plane that is not parallel to the plane of lay of the bars in the bending station. A typical case for example is that in the upstream station the bars are mutually side by side in a plane that is horizontal or slightly inclined relative to the horizontal (as in the case of the known device) and that in the bending station the bars must be arranged mutually aligned in a plane that is vertical (as in the case of the known device) or slightly inclined relative to the vertical. On the other hand, the pliers transfer means of the known device constitute a rigid system, in the sense that they are able to draw and deposit the bars set mutually side by side always according to the same orientation of their plane. Because of this limitation, the known device therefore must provide a complex system for transferring the bars from the station upstream of the bending station, which comprises additional transfer devices arranged in series with each other, one of which is dedicated solely to upsetting the bars from the plane in which they lie to the plane in which they must be positioned in the bending station, with the consequent prolongation of the cycle time and risk of overlaps between the bars.

SUMMARY OF THE INVENTION

The main object of the present invention is to provide an installation of the type specified at the outset which is simple and functional and which in particular is able to transfer bars between any two stations rapidly and without idle times, irrespective of the orientation of the plane of lay of the bars in each of the two stations.

An additional object of the invention is to use a single system for transferring the bars in an installation for bending the bars, both to transfer the bars from a position upstream of the bending station to said bending station, and to transfer the bars from the bending station to a third station for collecting the bent bars.

Yet another object of the invention is to provide an installation of the type specified above with transfer means which are able to draw the bars from the position upstream of the bending station irrespective of the conformation and arrangement of said station and of the orientation of the plane of lay of the bars in said station, in particular, both whether it is horizontal or vertical.

An additional specific object of the invention is to provide an installation of the type specified above with transfer means capable of depositing the bars to be bent or to draw the bars bent in said bending station irrespective of the orientation of the plane of lay of the bars in said bending station, in particular of whether said plane is vertical or inclined relative to the vertical.

BRIEF DESCRIPTION OF THE DRAWINGS

These and other objects are achieved by means of an installation having the characteristics specified in the accompanying claim 1. Additional advantageous characteristics of the installation according to the invention are specified in the claims. Lastly, the invention also relates to a method according to one or more of the claims.

The invention shall now be described with reference to the accompanying drawings, provided purely by way of non limiting example, in which.

DETAILED DESCRIPTION OF THE INVENTION

Figure 1:
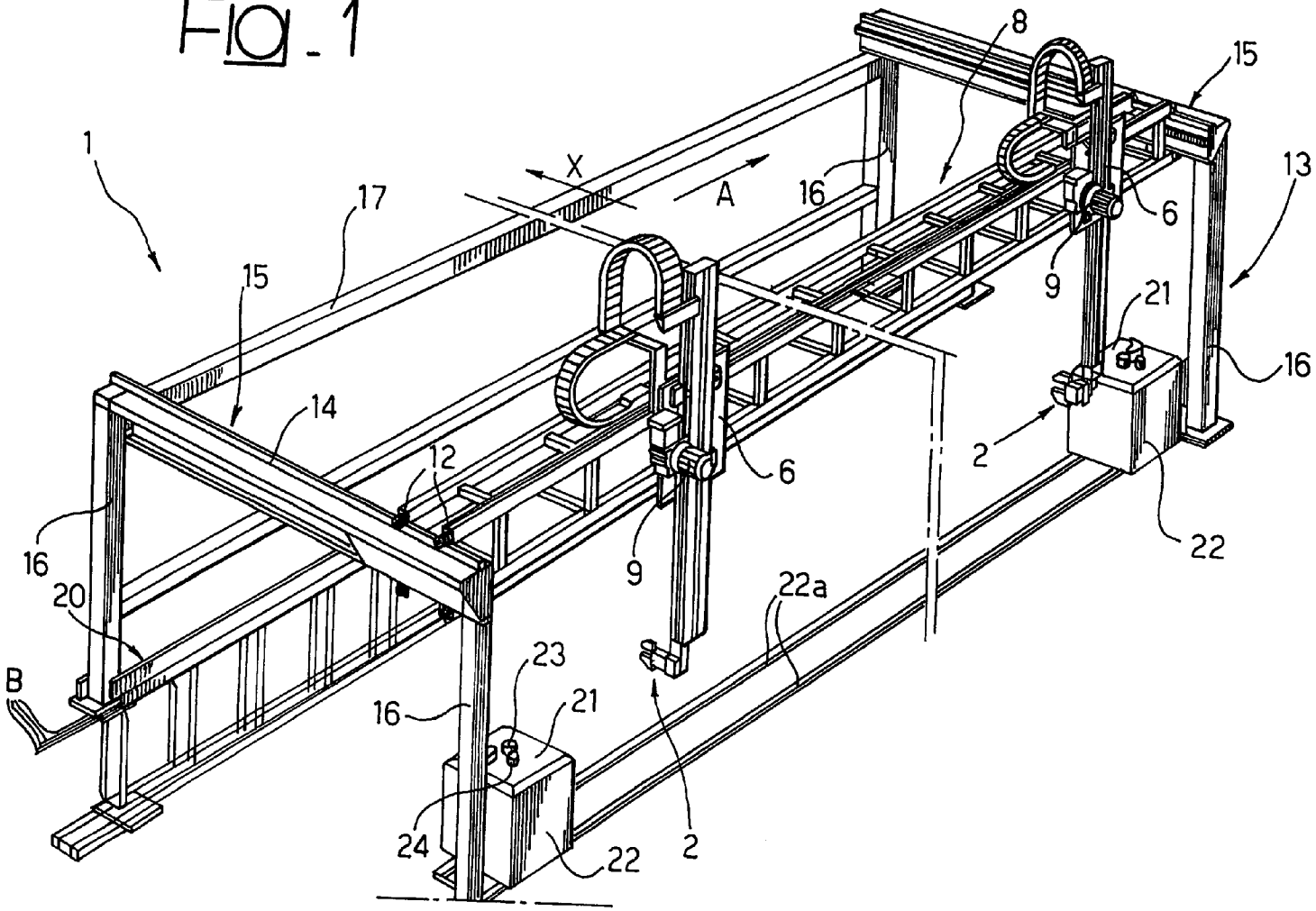
FIG. 1 globally shows a perspective view of a preferred embodiment of a transfer device according to the invention.

With reference to the drawings, the number 1 globally designates a device for transferring bars which, in the case of the illustrated example, comprises three grippers 2 (whereof only two are visible in FIG. 1). The three grippers 2 and the related actuation devices associated therewith are mutually identical, so that hereafter the structure and arrangement of only one of said pliers shall be described.

Figure 3:
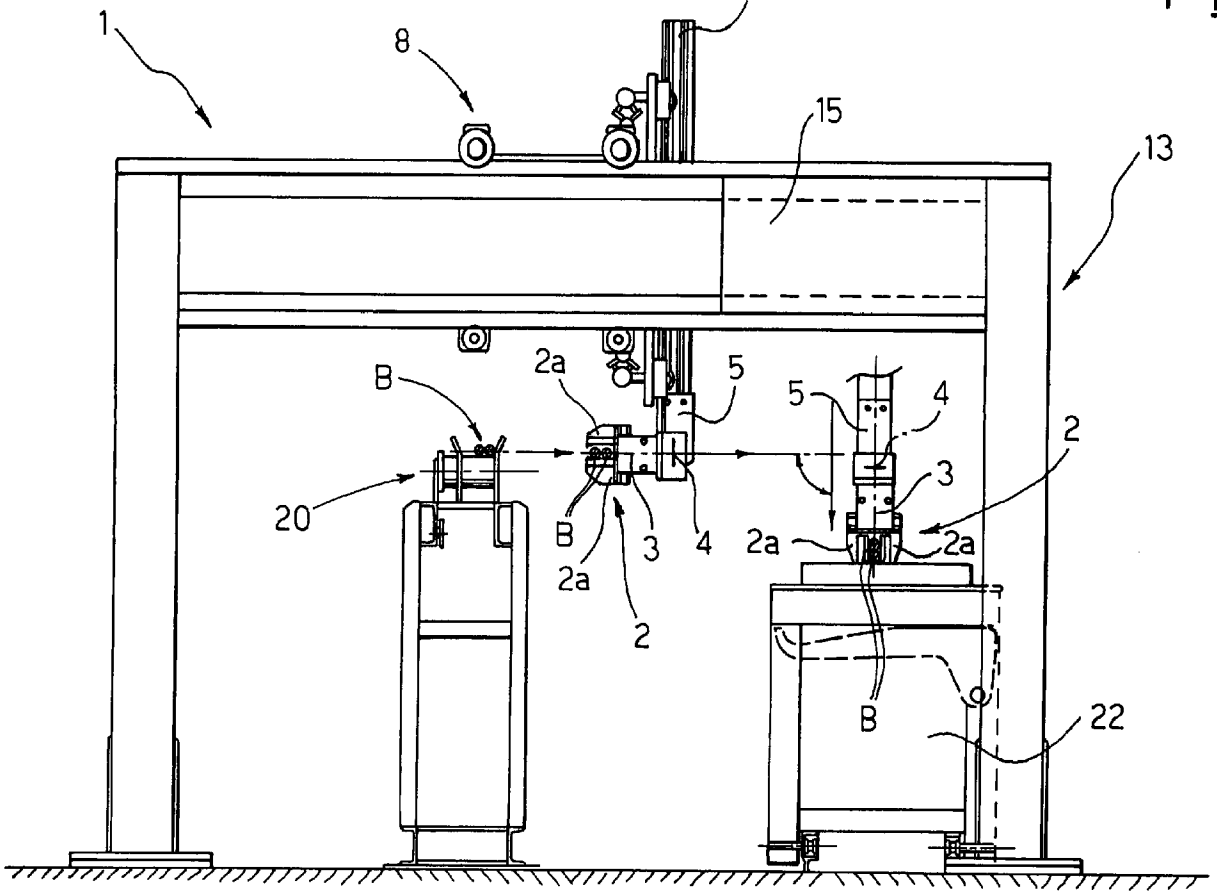
FIG. 3 is a side view of the device of FIG. 1.

As FIG. 3 clearly shows, each set of pliers 2 (i.e. each gripper) is borne by an articulated wrist 3 which is articulated in 4 to the structure of a vertically movable slide 5. Thanks to the articulation 4, the pliers 2 can oscillate between two operative conditions, both visible in FIG. 3, angularly offset with respect to each other, in the case of the specific example shown, by an angle of about 90°. In both positions, the jaws of the pliers 2, designated as 2*a*, are able to grip the bars B keeping them parallel to each other and substantially coplanar. In the first operative position (shown more to the left in FIG. 3) the pliers are oriented horizontally, to be able to draw and maintain the bars B set mutually side by side in a substantially horizontal plane, whilst the second operative position (shown more to the right in FIG. 3) keeps the bars B in a substantially vertical plane.

The drawings do not show in detail the structure of jaws 2*a* forming the pliers 2 and the manner in which said jaws are mounted and controlled. In general, the jaws 2*a* can be constructed in any known manner, for instance they can be mounted oscillating between an open position and a closed position, or capable of translating parallel to themselves between an open position and a closed position. In both cases, a mechanical transmission of any kind can be provided for driving the motion of the jaws between the open condition and the closed condition, said mechanical transmission being able to be actuated by an actuator of any kind, for instance a fluid cylinder, or an electric motor with related transmission. Therefore, such construction details can be provided in any known manner, as will be readily apparent to the person versed in the art. For this reason, such details have been omitted from the drawings, also to make them more readily and easily understandable.

Figure 2:
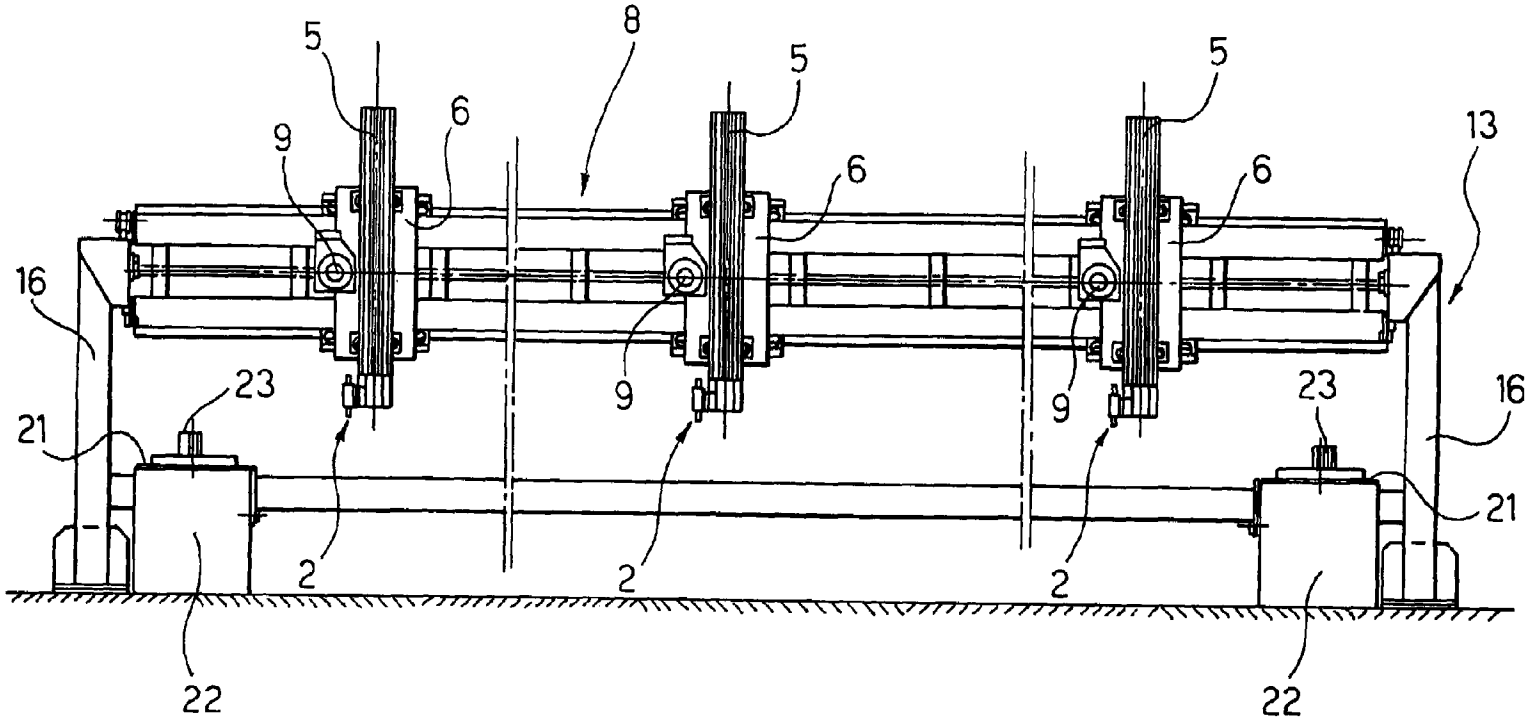
FIG. 2 is a front view of the device of FIG. 1.
Figure 4:
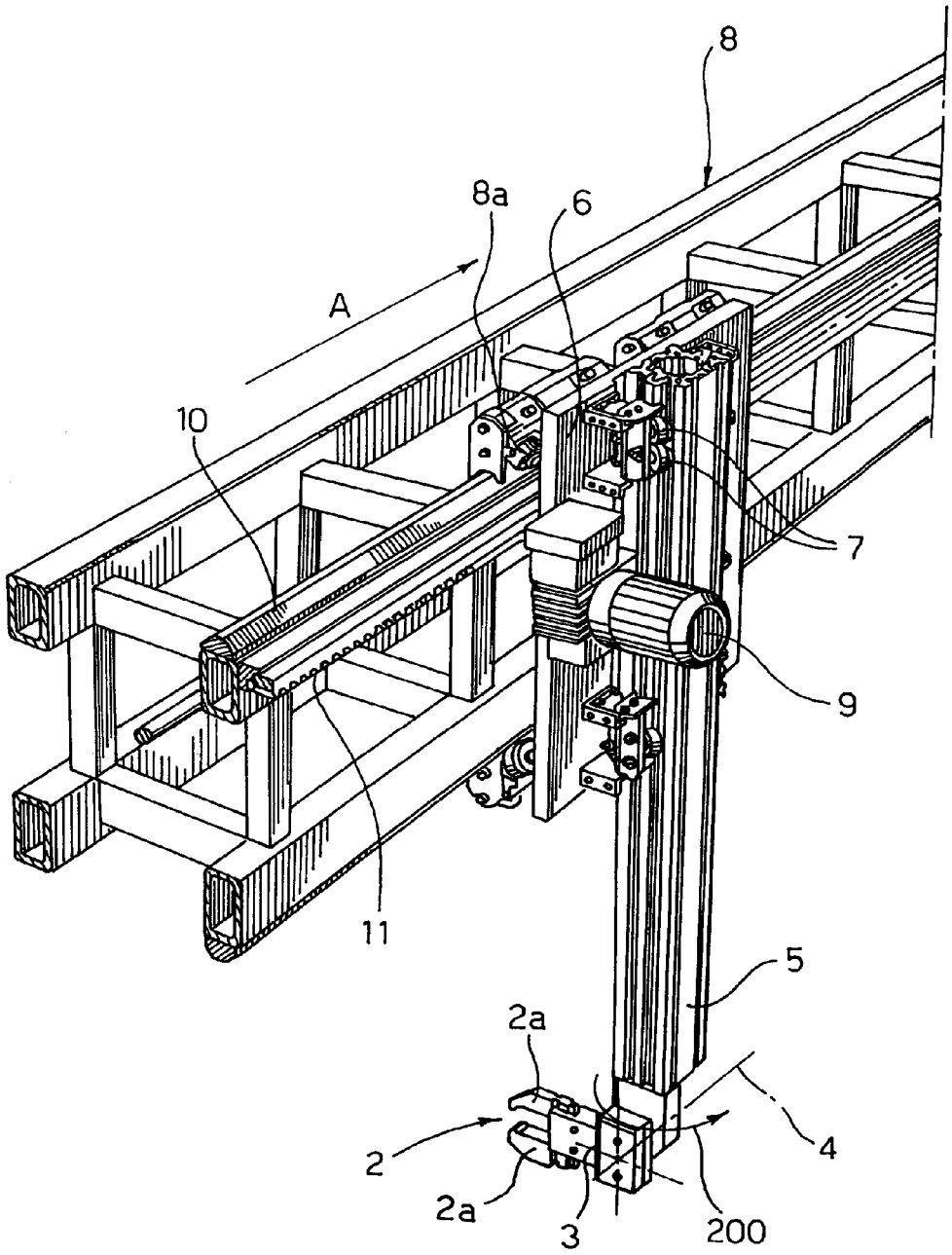
FIG. 4 is a perspective view in enlarged scale of a detail of the device of FIG. 1.

As indicated above, each set of pliers 2 is supported through the articulated wrist 3 on a sled 5 (which in the case of the illustrated example is constituted by a metal section bar—see FIG. 4) which is mounted vertically movable on a carriage 6, by means of guiding rollers 7. In the case of the illustrated example, three carriages 6 are in turn mounted able to slide in a direction A (see FIG. 4) parallel to the longitudinal direction of the bars; above an overhead travelling crane structure 8 which is mounted able to move, on a support frame 13 (FIG. 2) in a horizontal direction X perpendicular to the direction A (see FIG. 1).

Still with reference to FIG. 4, in the case of the illustrated example, the vertical movement of each sled relative to the carriage 6 is driven by an electric motor 9 through a gear transmission and a rack (not visible in the drawing). Similarly, the movement of each carriage 6 above the overhead travelling crane 8 is guided by means of rollers 8*a* which engage a rail 10 (FIG. 4) and driven by means of an electric motor and an associated gear transmission co-operating with a rack 11.

The overhead travelling crane structure 8 (FIG. 1) has at its ends guide rollers 12 which engage rails 14 borne by two upper cross members 15, which connect the upper ends of two pairs of columns 16. There is also a longitudinal beam 17 which connects the upper ends of the two columns positioned on a rear side of the installation.

The three sets of pliers 2 can be commanded simultaneously to grip the bars B which are in a drawing station 20 (FIG. 3) and to unload them in a bending area, above the upper planes 21 of two bending machines 22 known in themselves.

The two bending machines 22, in the case of the embodiment illustrated herein, can be moved on rails 22*a* parallel to the direction A as a function of the length of the bar to be bent and each of them has a fixed central mandrel 23 and an eccentric pivot pin 24 for bending the bars (FIG. 1). The bars to be bent are inserted mutually aligned in a vertical plane, setting on the planes 21 of the two bending machines 22 in the space defined between each mandrel 23 and a respective fixed abutting element 25 (see FIG. 5) for the bars to be bent. Also possible is the alternative known embodiment comprising a mandrel 23 with a central slit for the use of the bars.

The arrangement of the articulated wrist 3 bearing the pliers 2 allows to transfer the bars B of the station 20 to the bending station, above the upper planes of the bending machines 22, first making the bars rise and then the plane of lay of the bars rotate from the horizontal disposition to the vertical disposition.

Figure 5:
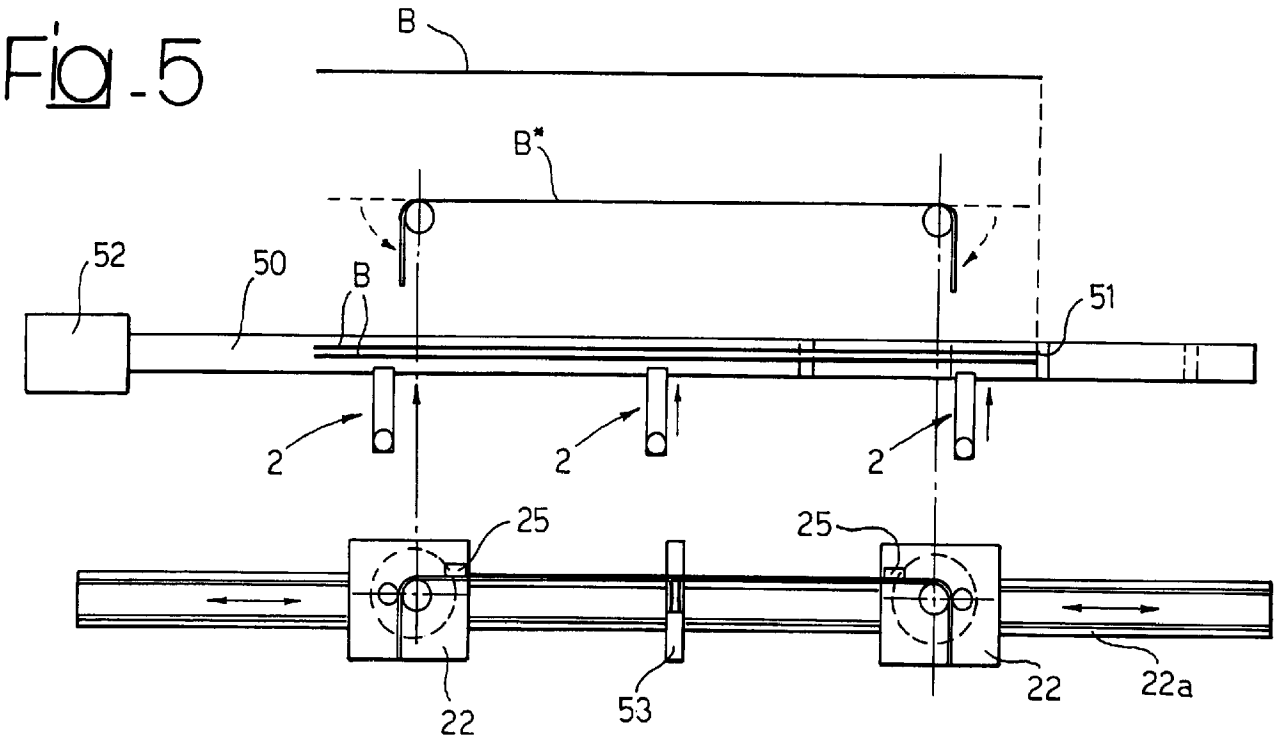
FIG. 5 is a schematic view of the installation of the invention.

FIG. 5 schematically shows a plan view of the preferred embodiment of the installation of the invention. The upper part of the figure also shows a bar B before bending and a bar B* after bending. The bars B are received on a cutting bench 50 where they are cut to the required length by means of a cutting head 52. The cut bars B are referred longitudinally by activating an abutting element 51 which can be raised (or any other equivalent element such as a pallet or movable mass), chosen selectively between a series of similar abutments, distributed along the bench 50, according to the length of the bars. Once the bars B have thus been longitudinally referred, they can be drawn and transported on the bending machines 22 which in the meantime have been positioned longitudinally in the proper positions to effect the shaping of the two ends of the bars, in order to bring each bar B (see upper part of FIG. 5) to assume the shape indicated as B*. Naturally the same result could also be obtained in installations of the type comprising a fixed and a movable bending machine, or, to generalise even more, even in installations comprising one or more than 2 bending machines, all or part of which may be fixed or movable. The pliers 2 unload the bars over the upper planes of the two bending machines 22, as well as on a fixed central vice 53 interposed between them. The longitudinal position of the bending machines 22 is varied according to the length of the bars, and of the bends to be effected, whilst the bars to be bent are positioned in such a way as to be placed with their intermediate central part over the vice 53, which is fixed.

Thanks to the arrangement described above, the transfer means of the invention can, in a particularly preferred case, perform solely (during the loading phase) a translation in the direction perpendicular to the longitudinal direction of the bar, without any movement with the pliers loaded in the latter direction. In the course of said movement, the wrist of the pliers performs the oscillation described above, in order to bring the plane of lay of the bars from the horizontal axis to the vertical axis with which the bars are received above the bending machines. It is possible to unload the cut bars which do not have to be bent at the other side of the structure 20 (see FIG. 7), for instance on a roller track 26 or on a floor storage area, by means of the pliers devices or even using a traditional dumping system or other known system.

An additional advantage of the invention relative to the installation disclosed by WO01/91936 consists of the capability of using the pliers 2 to draw the bars to be bent directly from a plane or channel of the cutting device, with no need for a manual intervention to transport the bars from the plane or channel of the cutting device to a drawing station, which allows to assign to a single operator the task of overseeing the entire cutting and bending cycle.

Figure 7:
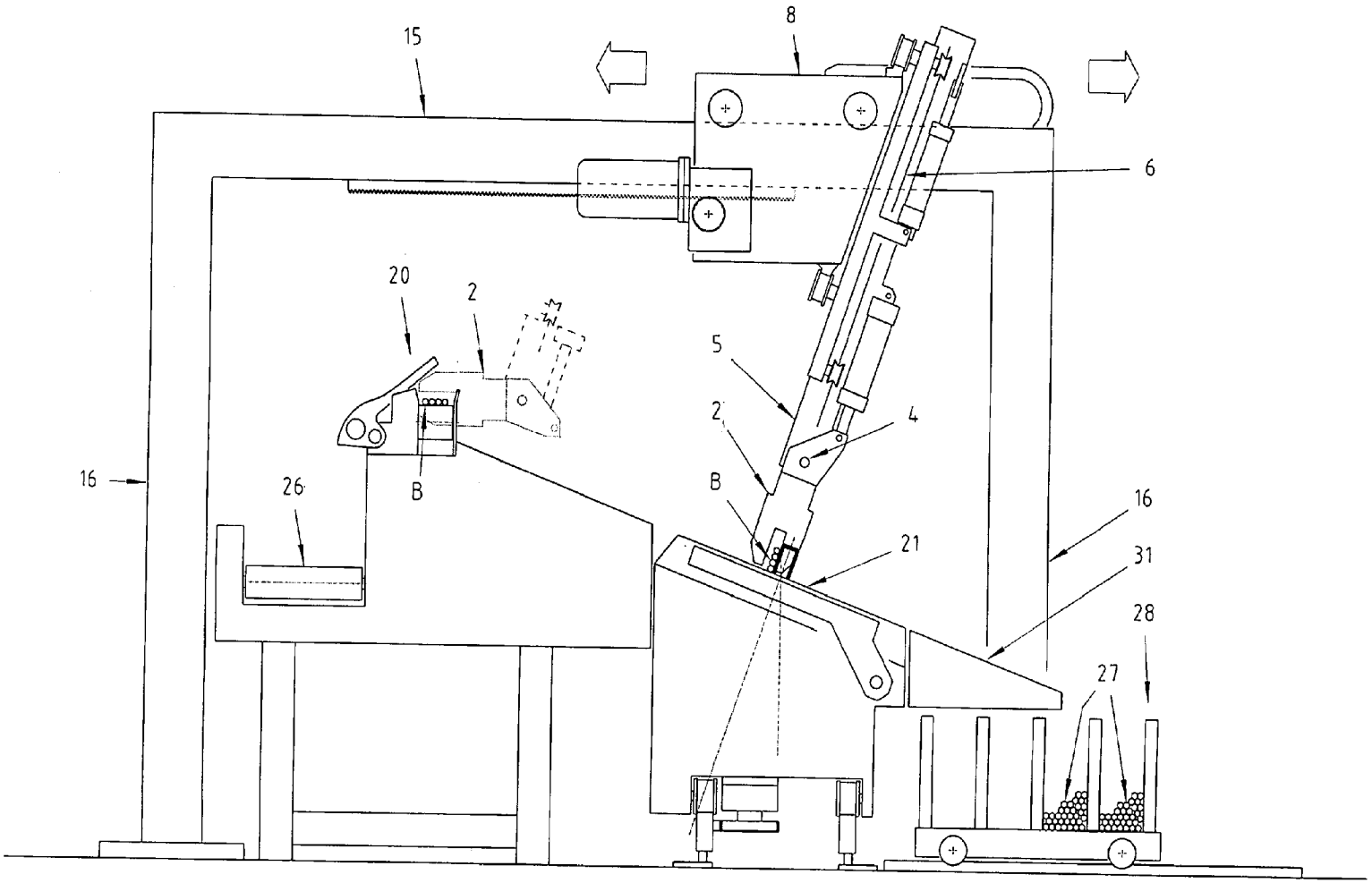
FIGS. 7,8 show an elevation view of two additional variations of the installation according to the invention.
Figure 8:
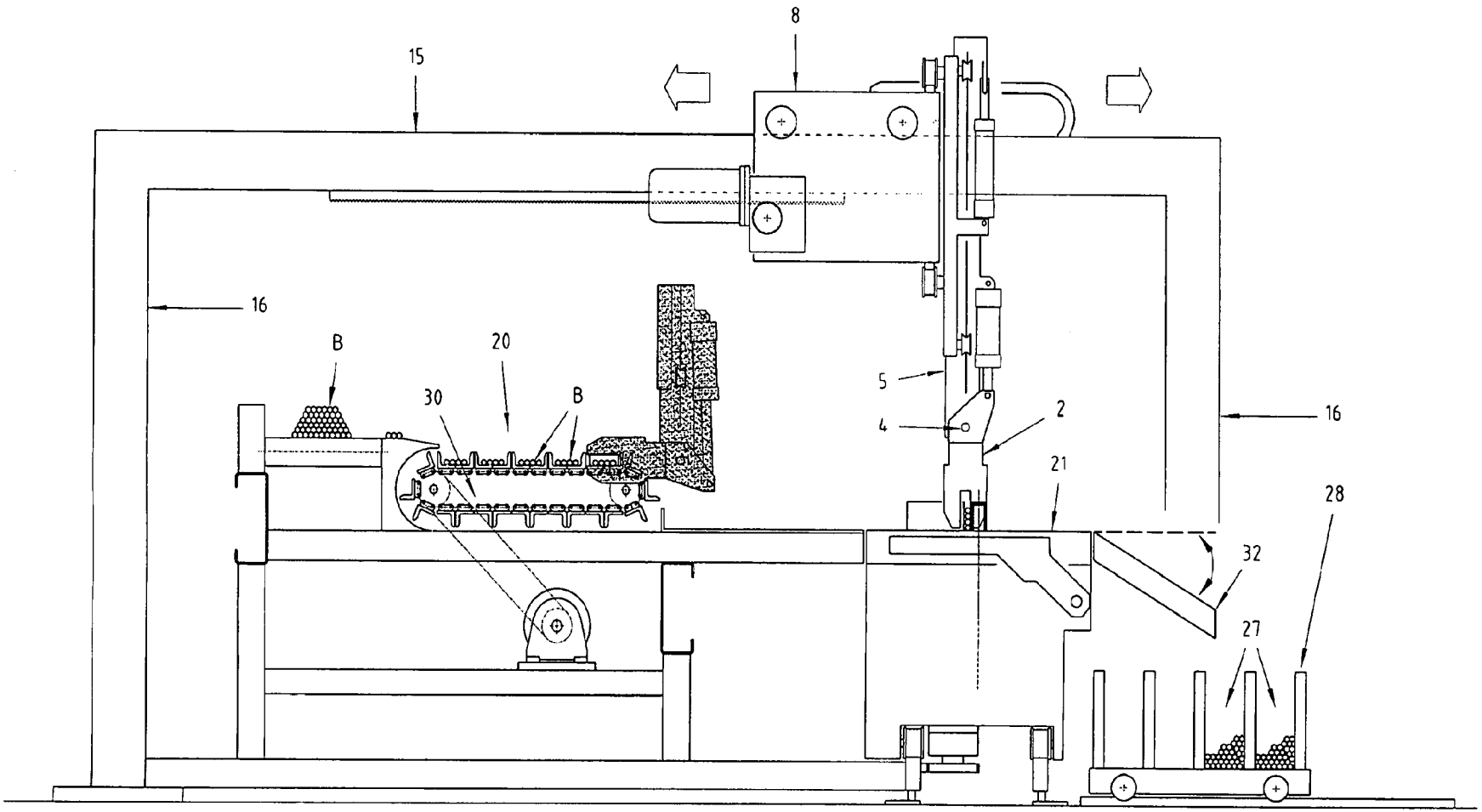

Naturally, the pliers can also be used to grip the bent bars again, at the end of the bending operation, and to lift them and transfer them to any unloading station, for instance constituted by a compartment 27 of a movable storage area 28 (FIGS. 7,8). It should be noted that in the drawing station 20, the bars B are supported over a rack structure, in such a way that the lower jaw 2*a* of each set of pliers 2 can be inserted below the plane of the bars to grip them. Moreover, one of the two jaws of the pliers 2 is preferably coated with plastic or rubber material, to enhance its grip.

Hereafter are provided some other examples of specific applications which in no way detract from the generality of the accompanying claims. The pliers can also be used to change the bending mandrels, appropriately adapting the shape thereof.

The support structure 13 of the example described above, illustrated in FIG. 1, may also be not fixed, but movable. In fact, in some cases the pliers may even be integral therewith in regard to the motions on at least an axis and it could be responsible for their movements in these directions. For instance when the structure (8) is an overhead travelling crane, it could be integral with the support (13) which instead would move on rails in the horizontal position perpendicular to A. The pliers would move in the aforementioned directions relative to the ground and/or to the first and second station. In particular cases, the first and/or the second stations could also move, but it would be much more expensive.

Naturally, there is no difference between handling iron segments originally in the form of straight bars or obtained straightening rolled iron (coil). Even when straightening is not perfect, the pliers assure a correct handling (for instance if the segments must be loaded in a bending installation, the pliers assure that, even the presence of a residual curvature, the segments fit without any problems between mandrel and reaction square). In the case of very low diameters of the bars, generally below 12 mm, it will be convenient to place the pliers closer to the mandrels of the bending installation during its loading. The same velocity of translation in the direction (A) of the bending machines as well as the translation or rotation velocity of the pliers must be adapted to the number of bars they bear and to their diameter and to the value of other significant parameters. Bending velocity will also be a function of the same parameters as well as of the range of the portion to be bent. Nothing excludes the possibility of using a single transfer means to serve multiple cutting or bending installations at the same time, or different phases of the productive process, for instance first transferring the bars to be cut to the cutting installation, then the cut segments therefrom to the bending installation, then the bent bar therefrom to an area for storing and classifying the processed material, lastly loading all onto lorries for shipment. On the contrary, multiple transfer means may be used to serve a single processing phase. Or else, different means can be destined to follow the different processing steps, for instance a transferring means could be destined to load the bending installation and another one to unload it. To simplify the structure and make it more economical, one of the transferring means could be split in two, for example by attaching thereto two series of pliers at fixed or even variable distances to execute a gripping operation and an unloading operation or two gripping operations or two unloading operations at the same time, but clearly the system would be somewhat less flexible. For example in the case of an overhead travelling crane structure, the overhead travelling crane could be split in two, placing between the two structures carriages whereon the two groups of pliers move, or more simply two distanced groups of pliers could be suspended from the same beam.

Figure 6:
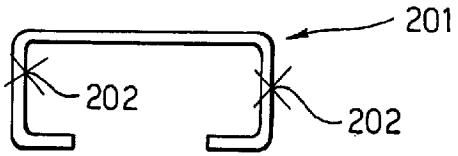
FIG. 6 shows a specific case of bent bar, with reference to a variation of the invention.

In regard to the unloading operation, an additional problem arises. Once bent, the bars can no longer be approximated to a one-dimensional system, as can be seen in the example of FIG. 6 (see profile 201). Therefore, by gripping the shaped figures along an axis parallel to the direction (A) they would be gripped the farther from the centre of gravity the more the figure obtained from the bending operation is extended along the horizontal axis perpendicular to (A). At this point, no matter how strong the grip, the shaped bar would be brought to rotate about the axis joining the points in which it is gripped until the equilibrium point with the weight force. This could represent a problem when a particularly precise unloading is needed with the stacking of multiple figures obtained in successive bending cycles. Already much better would be to grip the shaped bars (201) along the side having non zero projection on the horizontal axis normal to (A). However, it would be better yet to grip the figures in their centre of gravity (202) or at least in proximity thereto. To obtain a grip at the centre of gravity or near the centre of gravity in the point, however, two things are necessary: the software must be able to compute the position of the centre of gravity and the pliers (2) must be able to rotate about the vertical axis, for example by means of a rotating actuator applied between the articulated wrist (3) and the slide (5) in (200). Preferably, to the pliers gripping means are associated sensor means able to sense positions along the bars where the bars can be gripped, to avoid problems due to any irregularities, warping or non uniform bending of the bars. To stack many bent figures one on top of the other (but the same could be said for straight bars) once the assigned point is reached they cannot be simply let fall on the previous ones, but they must be laid delicately. Then the rise or descent of the pliers along the axis z must be able to be regulated precisely on all heights. The computer may derive the position along the vertical axis z of the shaped bars deposited during the previous cycle by obtaining the data from its own memory, but the risk remains that the figures may have moved or are warped on some side, thus changing their own height on the axis z relative to the foreseen one. Nor would it be completely useless to check the position of the shaped bars relative to the other two axes. The unloading storage area may be divided into sectors along both directions (A) and (X) and this is anyway necessary for precise stacking.

Thus the usefulness of a sensor that can identify the size of the shaped bars already deposited and their position is readily apparent. A precise positioning and stacking allow to facilitate the operations of binding and subsequently handling the bent shapes. Naturally, according to requirements, it will be preferred to unload the shaped bars and the bars on the ground, on intermediate storage spaces, movable storage spaces, conveyor belts, industrial conveyor belts, racks or lorries etc. Occasionally, it may be desired to move the iron packet directly in a binding machine or even to incorporate the latter in the load bearing structure of the pliers. Naturally, it will not always be necessary to group identical shaped bars together. Occasionally it may be necessary to group together different figures and even straight iron if in construction works it needs to be positioned close, as in certain pillars and floors. It will then be useful for the software of the machine, or even a program on another computer, to appropriately group the working lists or the unloading positions. If the laying of the bent material instead does nor required a high level of precision and the loading pliers set are not to used, in addition to traditional lever evacuation means in the automated bending installations, it could be possible to replace the pliers in the transfer devices described above, with L shaped, or hook shaped or spoon shaped apparatuses as described in the patent application TO2000A001008 by the same applicant and it would not be necessary for the latter to rotate about the vertical axis. Or else, different gripping means could be used, such as magnets. These same systems could be employed in other parts of the installation, for example to transfer the material from the temporary storage to the lorries.

Calculating the centre of gravity, in addition, would be very useful even when it is necessary to handle straight segments of bars that are so short as to require the use of only one set of pliers, so they are gripped in proximity to the centre of gravity. Even in the normal handling of straight long bars a weight distribution analysis together with the calculation of flexure and bellying for different diameters would be helpful in the selection of the grip point and of the proximity of the pliers 2 to the bending machines at the time of unloading.

If the plane defined by the upper planes 21 of the bending units 22 is not horizontal but inclined (see FIG. 7) the structure of the wrist 3 would no longer have to allow a rotation of the wrist between 0 and 90 degrees relative to the vertical axis, but rather shift from a first operative position in which the gripping plane of the bars is horizontal to a second operative position in which the gripping plane of the bars is normal to the plane defined by the upper planes 21 of the bending units 22. In this case, in order further to simplify the structure of the machine and not require the presence, between the wrist 3 and the slide 5, of such an apparatus at to allow the movement of the pliers along an axis normal to the plane defined by the upper planes 21 of the bending units 22 it will be sufficient for the slide 5, instead of being oriented along the vertical, to be normal to the plane defined by the upper planes 21 (FIG. 7). In this way the movement of the slide, associated with the rotation of the wrist, will be sufficient to load the bending units. Naturally, the slide may also assume different angles when this is convenient to simplify gripping, transporting or unloading, such as if the bars or the shaped bars were to be loaded in inclined racks. To include particular cases in which the first station is not horizontal and/or the bars are not to be loaded in bending units, but in different apparatuses, it can be stated that the wrist 3 can be made to rotate between a first operative position for drawing defining a certain gripping plane, appropriate for loading, and a second operative position defining a second gripping plane suitable for unloading. In the case of unloading onto a storage structure or a transport unit, the structure in addition to not being horizontal may require an angle of incidence of the trajectory of the pliers thereon which is neither zero nor ninety degrees, for instance to insert the bars in angles slits. On the other hand, also the upper cross members 15, in the case of an apparatus similar to that of FIG. 7, could be inclined in such a way as to prevent the height differential between the bending unit and the structure 8 borne by the cross members 15 from becoming excessive. In this case, the vertical reference will no longer be the absolute one, but the axis perpendicular to the plane defined by the upper planes 21 of the bending units 22. This naturally holds true not only when the structure 8 is an overhead travelling crane, but also when each pliers assembly is suspended from an independent support and moves on the horizontal plane only in the direction (X) perpendicular to (A) except for any vertical movements.

There could be the case in which the transfer means comprise one or more sets of pliers, movable relative to a support structure 13 only in a direction perpendicular to the longitudinal direction of the bars and not along A. In this case a greater number of pliers will be necessary and the bending units will have to move into the operative position after the loading of the bars, possibly butting the bars with an abutment pallet borne on one of the bending units and thrusting them by means of the latter, moving the rod bending machine whereon it is mounted to overcome system asymmetries and reach the relative position between the rod and the bending machine, necessary to perform the first bending operation. Naturally, other butting means may be provided. What is indicated above can be achieved both when the structure (5) which bears each set of pliers (2) is suspended from an independent shelf and when the pliers are all attached to the overhead travelling crane structure (8), but are not movable thereon along (A).

Or else, on the contrary, the structure that supports the pliers transfer means could be attached to the bending units.

Particularly convenient is to construct the wrist 3 of such a length that both in the loading position and in the unloading position the movable carriage 5 is at the same height along its own axis of sliding, which allows for example to use a simple two-position cylinder to actuate the carriage 5.

In the particularly preferred case illustrated above, in which the central pliers are fixed relative to the direction A, it may bear the jaws 2*a* doubled and mutually distanced by a few centimetres so that when they drop to load the bending machines they position themselves at the sides of the central vice 53, enhancing system symmetry. Doubled or multiply split jaws can in any case be used also elsewhere to improve grip stability.

The means for transferring the bars can also be used in a bending installation in which both bending units are fixed. In this case they shall also provide for all movements of the bars in the direction A.

In the case in which the installation receives a quantity of bars that is too large to be loaded by the pliers at one time, as in the case of large installations provided with shears capable of cutting even more that 100 bars at a time, it will be necessary to open up the bundles before bringing them to the drawing station. This can be done with any known system and even by hand, but the most convenient way is to separate an appropriate number of bars laterally relative to the main bundle. The applicant has already constructed and patented also automated counting and/or drawing systems. Occasionally, the particular need arises of causing the bars within the bending machines and hence also within the pliers all to have the fins of the ribs oriented in the same direction (mainly vertically between the central mandrels 23 and the respective reaction squares) to enhance the consistency of the radius of curvature and prevent the bundle from opening. In this case the intervention of an operator is particularly indicated. The bars may be loaded onto a parallel chain conveyor system 30, arranging them side by side in a horizontal plane (FIG. 8). The bars (B) shall be arranged each on a link of the chains. It will thereby be possible to turn them with the fins of the ribs all arranged in the same direction (which was not possible with the system disclosed by WO 01/91936, in which in fact the bars could even overlap during their drop into the first set of pliers or their passage between the latter and the second transfer apparatus). The device of the invention is thus able to draw the bars with the pliers when the bin of the catenary that contains them reaches the last position. The pliers enter the free spaces between the links of the chains, securely grip the bars perfectly oriented and aligned and by means of a rotation, an optional movement along z and a translation along (X) bring them to the second station. In this case the catenary will preferably be horizontal or even provided with a moderate inclination.

Or it may be decided to use any other apparatus in which the bars lie stacked and set side by side on any other plane. It will be preferable for this apparatus to be provided with multiple compartments translating in the direction (X), to prevent the operator from placing his/her hands near the operating area of the pliers and to provide a buffer between the manual unloading and the loading with the pliers. The bars may be butted before being transferred on said apparatus by means of any of the known systems.

In the particularly preferred form described in greater detail by way of example and illustrated in the drawings from 1 to 5, the pliers to draw the bars from the drawing station 20 must be inserted into the slits present in the walls of the structure 20 itself to avoid collisions. The control exerted by the electronics and by the software would in itself be sufficient to assure the correct positioning of the pliers along the axis A, but for additional safety it is possible to position on the structure 8 of the overhead travelling crane (or on the other possible structures for managing the translation of the pliers in the direction A in correspondence with the slits provided for gripping in 20, cooperating members readable by sensors borne by the carriages 6 (or by other parts of the system that bears the pliers) which allow to deny consent to the approach of the pliers to 20 unless the position is the proper one. For example, the cooperating members could be made in reflecting material and the sensors photocells, or proximity switches could be used. It could also be possible to invert the relative positions of the sensors and of the cooperating members, but the cost would rise.

It would not make much difference to provide the structure 20 with lateral walls able to be lowered because the risk of collision with the supports of the rods would remain.

It would also be possible to use a single bending unit to bend the rod while holding it with one or more pliers and, exploiting the relative motion along the axis A between machine and pliers, to execute the bending operations on the various sides. It would then be possible to eliminate the vice 53. For example from the start the rod could be held at the central side of the machine (in FIG. 5 between the bending machine and where the vice 53 is located), then move the pliers to the exterior side of the machine to handle the rod in the final bends. Or to keep part of the pliers externally and part internally. This not only to build an installation provided with a single bending unit, but also within an installation provided with two or more bending units to obtain particular figures, for instance those provided with all sides shorter than the minimum distance achievable between the bending centres of two bending machines.

Whichever system is selected for unloading, for example the pliers or the traditional lever ejectors of bending installations, possibly associated to a tiltable table (32) (FIG. 8) positioned at the side of the bending machines opposite the drawing station or a fixed inclined plane 31 (FIG. 7) in the same position, it could be possible to use a movable storage space 28 like the one described in the Italian patent application TO2002A000683 by the same Applicant, still secret, having compartments or bins 27 where the processed material is deposited awaiting a new handling, possibly also by transfer means of the type described herein. Said movable storage space in some cases shall need a large width (in the direction orthogonal to A) and possibly a high number of bins 27. If unloading with a pliers device, it will be sufficient to arrange for said pliers device to have a sufficiently long travel in the horizontal direction orthogonal to A, but if unloading takes place by means of sliding on an inclined plane (31) or a tiltable table (32), their width may not be sufficient to allow all the bins of the movable storage space to be positioned under the unloading position whilst the remaining portion of the storage space is inserted under them (the table in inclined position and the fixed inclined plane will have a sufficient height from the ground to let the movable storage space pass underneath them). It could then be useful to provide a catenary device (close loop chain conveyor)to collect the bars, like the device 30 of FIG. 8.

Building the catenary with an appropriate width and providing it with such a height that the movable storage space can pass underneath it, it will now unload from the bending installation onto the bin in the first position of the catenary and then moving it on its closed loop the bin will end up occupying the last position and it will unload the bent material onto the movable storage space which now may have far greater useful width.

Moreover, to reorient the longitudinal direction of the bars, the same structure (8) which bears the structures whereto the pliers are fastened can be enabled to rotate about an axis that is perpendicular or parallel to the plane of lay of the bars.

Preferably, two bending units are provided as well as a plurality of planes, able to be loaded, for supporting the bars, able to fill the space available along the longitudinal direction A between the two bending units and/or externally thereto, in accordance with what is proposed in a previous Italian patent application by the same applicant, TO2002A000683, still secret as of the date of filing of the present application whose content is to be construed as incorporated by reference. Also preferably, to at least a bending unit can be associated an auxiliary support movable between an inoperative position to the rear and an operative position in which it surmounts at least partially the revolving disk of the bending unit, as provided in the previous Italian patent application no. TO2003A000035 by the same applicant, still secret as of the date of filing of the present application whose content is to be construed as incorporated by reference. In this way, in a cycle of bending operations necessary to obtain a closed loop stirrup of quadrangular shape starting from a rectilinear bar, it is assured, in the final phase of the bending cycle, that the end portions of the bar constituting each stirrup are mutually approached without risk of interference between the bar portions in motion and the central mandrel of the bending unit and/or the opposite ends of the bars.

It is also evident that the transfer means of the invention can be used to achieve the transfer of the bars between any two stations of the plant, also both upstream or downstream of the bending, and in general wherever it is advantageous to accomplish this transfer automatically.

Naturally, without altering the principle of the invention, the construction details and the embodiments may vary widely from what is described and illustrated purely by way of example, without thereby departing from the scope of the present invention.

What is claim is:

1. An installation for processing metal bars for concrete reinforcement, comprising:

first means for transferring the bars (B) from a first station (20) which receives bars which are to be subjected to a bending operation in said installation to a bending station, comprising a bending unit (22), and second means for transferring bars (B) from said bending station, once the bars have been bent therein, to a third unloading station (28), wherein said first means for transferring comprise:

a supporting frame (13) in the installation, a gripper (2), including:

a gripper supporting structure (5) guided on said supporting frame, so as to be movable in the installation, relative to the bending station along a first direction (A) which is horizontal and parallel to a longitudinal direction of the bars in the installation and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which in turn is pivotally mounted on said gripper supporting structure (5) around a substantially horizontal axis of articulation (4), and wherein means are provided for controlling the rotation of said wrist member of each gripper about said axis of articulation (4) so as to be capable of orienting said gripper (2) in an angular position around said axis of articulation (4) relative to the gripper supporting structure, while the gripper supporting structure is movable along said longitudinal and transverse directions (A, X) relative to the bending station, wherein the gripper (2) is able to be moved along any of said two directions (A, X) to grip the bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, and wherein the same grippers (2) are arranged so that they can be used both as the first means for transferring the bars (B) from the first station (20) to the bending station and as the second means for transferring the bars (B) from said bending station to the third unloading station (28), wherein the supporting frame for the gripper is a frame overlying the first station, the bending station and the unloading station.

2. An installation for processing metal bars for concrete reinforcement, comprising:

first means for transferring the bars (B) from a first station (20) which receives bars which are to be subjected to a bending operation in said installation to a bending station, comprising a bending unit (22), and second means for transferring bars (B) from said bending station, once the bars have been bent therein, to a third unloading station (28), wherein said first means for transferring comprise:

a supporting frame (13) in the installation, a gripper (2), including:

a gripper supporting structure (5) guided on said supporting frame, so as to be movable in the installation, relative to the bending station along a first direction (A) which is horizontal and parallel to a longitudinal direction of the bars in the installation and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which in turn is pivotally mounted on said gripper supporting structure (5) around a substantially horizontal axis of articulation (4), and wherein means are provided for controlling the rotation of said wrist member of each gripper about said axis of articulation (4) so as to be capable of orienting said gripper (2) in an angular position around said axis of articulation (4) relative to the gripper supporting structure, while the gripper supporting structure is movable along said longitudinal and transverse directions (A, X) relative to the bending station, wherein the gripper (2) is able to be moved along any of said two directions (A, X) to grip the bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, and wherein the same grippers (2) are arranged so that they can be used both as the first means for transferring the bars (B) from the first station (20) to the bending station and as the second means for transferring the bars (B) from said bending station to the third unloading station (28), wherein the gripper supporting structure (5) is mounted on a carriage (6) which is movable along an overhead cross member structure (8) which in turn is movable in the manner of an overhead traveling crane relative to the supporting frame (13).

3. An installation as claimed in claim 2, wherein the gripper supporting structure comprises a plurality of grippers (2), with their respective carriages (6) carried on a common overhead cross-member structure (8).

4. An installation for processing metal bars for concrete reinforcement, comprising:

first means for transferring the bars (B) from a first station (20) which receives bars which are to be subjected to a bending operation in said installation to a bending station, comprising a bending unit (22), and second means for transferring bars (B) from said bending station, once the bars have been bent therein, to a third unloading station (28), wherein said first means for transferring comprise:

a supporting frame (13) in the installation, gripper means (2), each including:

a gripper supporting structure (5) guided on said supporting frame, so as to be movable in the installation, relative to the bending station along a first direction (A) which is horizontal and parallel to a longitudinal direction of the bars in the installation and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which in turn is pivotally mounted on said gripper supporting structure (5) around a substantially horizontal axis of articulation (4), and wherein means are provided for controlling the rotation of said wrist member of each gripper about said axis of articulation (4) so as to be capable of orienting said gripper (2) in an angular position around said axis of articulation (4) relative to the gripper supporting structure, while the gripper supporting structure is movable along any of said longitudinal and transverse directions (A, X) relative to the bending station, wherein the gripper (2) is able to be moved along any of said two directions (A, X) to grip the bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, and wherein said first station (20) is a supporting surface (50) whereon the bars are supplied to be cut into segments of predetermined length, wherein the gripper supporting structure (5) is mounted on a carriage (6) which is movable along an overhead cross member structure (8)

which in turn is movable in the manner of an overhead traveling crane relative to the supporting frame (13).

5. An installation as claimed in claim 4, wherein the gripper supporting structure comprises a plurality of grippers (2), with their respective carriages (6) movable along respective overhead cross-member structures (8) able to slide in the manner of overhead traveling cranes on the support frame (13).

6. An installation for processing metal bars for concrete reinforcement, comprising:

first means for transferring the bars (B) from a first station (20) which receives bars which are to be subjected to a bending operation in said installation to a bending station, comprising a bending unit (22), and second means for transferring bars (B) from said bending station, once the bars have been bent therein, to a third unloading station (28), wherein said first means for transferring comprise:

a supporting frame (13) in the installation, a gripper (2), including:

a gripper supporting structure (5) guided on said supporting frame, so as to be movable in the installation, relative to the bending station along a first direction (A) which is horizontal and parallel to a longitudinal direction of the bars in the installation and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which in turn is pivotally mounted on said gripper supporting structure (5) around a substantially horizontal axis of articulation (4), and wherein means are provided for controlling the rotation of said wrist member of each gripper about said axis of articulation (4) so as to be capable of orienting said gripper (2) in an angular position around said axis of articulation (4) relative to the gripper supporting structure, while the gripper supporting structure is movable along said longitudinal and transverse directions (A, X) relative to the bending station, wherein the gripper (2) is able to be moved along any of said two directions (A, X) to grip the bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, and wherein the same grippers (2) are arranged so that they can be used both as the first means for transferring the bars (B) from the first station (20) to the bending station and as the second means for transferring the bars (B) from said bending station to the third unloading station (28), wherein said gripper supporting structure (5) is movable also in a third direction which is perpendicular to a working plane (21) of said bending station; and wherein the gripper supporting structure (5) is slidably mounted along said third direction on a carriage (6) which is movable along an overhead cross member structure (8) which in turn is movable in the manner of an overhead traveling crane relative to the supporting frame (13).

7. An installation as claimed in claim 6, wherein the two directions of movement of said carriage (6) and said overhead cross-member structure (8) are horizontal and said third direction of movement of said gripper supporting structure is vertical.

8. An installation as claimed in claim 6, wherein the two directions of movement of said carriage (6) and said overhead cross-member structure (8) are horizontal and said third direction of movement of said gripper supporting structure is inclined both to the vertical and the horizontal.

9. An installation for processing metal bars for concrete reinforcement, comprising:

first means for transferring the bars (B) from a first station (20) which receives bars which are to be subjected to a bending operation in said installation to a bending station, comprising a bending unit (22), and second means for transferring bars (B) from said bending station, once the bars have been bent therein, to a third unloading station (28), wherein said first means for transferring comprise:

a supporting frame (13) in the installation, gripper means (2), each including:

a gripper supporting structure (5) guided on said supporting frame, so as to be movable in the installation, relative to the bending station along a first direction (A) which is horizontal and parallel to a longitudinal direction of the bars in the installation and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which in turn is pivotally mounted on said gripper supporting structure (5) around a substantially horizontal axis of articulation (4), and wherein means are provided for controlling the rotation of said wrist member of each gripper about said axis of articulation (4) so as to be capable of orienting said gripper (2) in an angular position around said axis of articulation (4) relative to the gripper supporting structure, while the gripper supporting structure is movable along any of said longitudinal and transverse directions (A, X) relative to the bending station, wherein the gripper (2) is able to be moved along any of said two directions (A, X) to grip the bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, and wherein said first station (20) comprises a supporting surface (50) whereon the bars are supplied to be cut into segments of predetermined length, wherein the bending station comprises two mutually spaced apart bending units (22), positioned laterally relative to the bench (50), whereon the cut bars are set down to be bent according to predetermined shapes and in that the two bending units (22) are movable with respect to one another along the longitudinal direction (A) of the bars.

10. An installation for processing metal bars for concrete reinforcement, comprising:

first means for transferring the bars (B) from a first station (20) which receives bars which are to be subjected to a bending operation in said installation to a bending station, comprising a bending unit (22), and second means for transferring bars (B) from said bending station, once the bars have been bent therein, to a third unloading station (28), wherein said first means for transferring comprise:

a supporting frame (13) in the installation, gripper means (2), each including:

a gripper supporting structure (5) guided on said supporting frame, so as to be movable in the installation, relative to the bending station along a first direction (A) which is horizontal and parallel to a longitudinal direction of the bars in the installation and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which in turn is pivotally mounted on said gripper supporting structure (5) around a substantially horizontal axis of articulation (4), and wherein means are provided for controlling the rotation of said wrist member of each gripper about said axis of articulation (4) so as to be capable of orienting said gripper (2) in an angular position around said axis of articulation (4) relative to the gripper supporting structure, while the gripper supporting structure is movable along any of said longitudinal and transverse directions (A, X) relative to the bending station, wherein the gripper (2) is able to be moved along any of said two directions (A, X) to grip the bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, and wherein said first station (20) comprises is a supporting surface (50) whereon the bars are supplied to be cut into segments of predetermined length, wherein the first station further includes a support plane arranged adjacent to said supporting surface for receiving the cut bars, said plane being defined by the upper branches of a plurality of endless chains (30) arranged in vertical planes parallel to said transverse direction (X).

11. An installation for processing metal bars for concrete reinforcement, comprising:

first means for transferring the bars (B) from a first station (20) which receives bars which are to be subjected to a bending operation in said installation to a bending station, comprising a bending unit (22), and second means for transferring bars (B) from said bending station, once the bars have been bent therein, to a third unloading station (28), wherein said first means for transferring comprise:

a supporting frame (13) in the installation, gripper means (2), each including:

a gripper supporting structure (5) guided on said supporting frame, so as to be movable in the installation, relative to the bending station along a first direction (A) which is horizontal and parallel to a longitudinal direction of the bars in the installation and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which in turn is pivotally mounted on said gripper supporting structure (5) around a substantially horizontal axis of articulation (4), and wherein means are provided for controlling the rotation of said wrist member of each gripper about said axis of articulation (4) so as to be capable of orienting said gripper (2) in an angular position around said axis of articulation (4) relative to the gripper supporting structure, while the gripper supporting structure is movable along any of said longitudinal and transverse directions (A, X) relative to the bending station, wherein the gripper (2) is able to be moved along any of said two directions (A, X) to grip the bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, and wherein said first station (20) comprises a supporting surface (50) whereon the bars are supplied to be cut into segments of predetermined length, further comprising unloading means for unloading bars which are not to be subjected to a bending operation from said supporting surface on a side thereof opposite to that facing the bending station.

12. An installation as claimed in claim 11, wherein said unloading means comprises roller tracks to receive bars which are not to be subjected to a bending operation.

13. An installation for processing metal mean bars for concrete reinforcement, comprising:

first means for transferring the bars (B) from a first station (20) which receives bars which are to be subjected to a bending operation in said installation to a bending station, comprising bending units (22), and second means for transferring bars (B) from said bending station, once the bars have been bent therein, to a third unloading station (28), wherein said first means for transferring comprise:

a supporting frame (13) in the installation, grippers (2), each including:

a gripper supporting structure (5) guided on said supporting frame, so as to be movable in the installation, relative to the bending station along a first direction (A) which is horizontal and parallel to a longitudinal direction of the bars in the installation and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which on its turn is pivotally mounted on said gripper supporting structure (5) around a substantially horizontal axis of articulation (4), and in that wherein means are provided for controlling the rotation of said wrist member of each gripper about said axis of articulation (4) so as to be capable of orienting said gripper (2) in any angular position around said axis of articulation (4) relative to the gripper supporting structure, while the gripper supporting structure is movable along any of said longitudinal and transverse directions (A, X) relative to the bending station, wherein the gripper (2) is able to be moved along any of said two directions (A, X) to grip the bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, wherein said gripper supporting structure (5) is movable also in a third direction which is perpendicular to a working plane (21) of said bending station, said third direction being inclined both to the vertical and the horizontal, wherein the gripper supporting structure (5) is slidably mounted along said third direction on a carriage (6) which is movable along an overhead cross member structure (8) which in turn is movable in the manner of an overhead traveling crane relative to the supporting frame (13), and wherein the two directions of movement of said carriage (6) and said overhead cross-member structure (8) are horizontal.

14. An installation as claimed in claim 13, wherein the first station includes a support plane defined by upper branches of a plurality of endless chains (30) arranged in vertical planes parallel to said transverse direction (X).

15. An installation for processing metal bars for concrete reinforcement, comprising:

first means for transferring the bars (B) from a first station (20) which receives bars which are to be subjected to a bending operation in said installation to a bending station, comprising bending unit means (22), and second means for transferring the bars (B) from said bending station, once the bars have been bent therein, to a third unloading station (28), in which said first transferring means comprise:

a supporting frame (13) in the installation, grippers (2), including:

a gripper supporting structure (5) guided on said supporting frame, so as to be movable in the installation, relative to the bending station, at least along a first direction (A) which is horizontal and parallel to a longitudinal direction of the bars in the installation, and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of the gripper (2) are mounted on a wrist member (3) which on its turn is pivotally mounted on said gripper supporting structure (5) around a substantially horizontal axis of articulation (4), and wherein means are provided for controlling the rotation of said wrist member of each gripper about said axis of articulation (4) so as to be capable of orienting said gripper (2) in any angular position around said axis of articulation (4) relative to the gripper supporting structure, while the gripper supporting structure is able to be moved along any of said longitudinal and transverse directions (A, X) relative to the bending station, so that the gripper (2) is able to be moved along any of said two directions (A, X) to grip said bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, wherein said gripper supporting structure (5) is movable also in a third direction which is perpendicular to a working plane (21) of said bending station, and wherein the wrist member (3) of each gripper (2) is pivotally mounted around said articulation axis (4) on a structure which is pivotally supported by said gripper supporting structure (5) around an axis parallel to said third direction, wherein means are provided for controlling the grippers, programmable to calculate the position of the centre of gravity of the bars.

16. An installation for processing metal bars for concrete reinforcement, comprising:

first means for transferring the bars (B) from a first station (20) which receives bars which are to be subjected to a bending operation in said installation to a bending station, comprising bending unit means (22), and second means for transferring the bars (B) from said bending station, once the bars have been bent therein, to a third unloading station (28), in which said first transferring means comprise:

a supporting frame (13) in the installation, grippers (2), including:

a gripper supporting structure (5) guided on said supporting frame, so as to be movable in the installation, relative to the bending station, at least along a first direction (A) which is horizontal and parallel to a longitudinal direction of the bars in the installation, and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of the gripper (2) are mounted on a wrist member (3) which on its turn is pivotally mounted on said gripper supporting structure (5) around a substantially horizontal axis of articulation (4), and wherein means are provided for controlling the rotation of said wrist member of each gripper about said axis of articulation (4) so as to be capable of orienting said gripper (2) in any angular position around said axis of articulation (4) relative to the gripper supporting structure, while the gripper supporting structure is able to be moved along any of said longitudinal and transverse directions (A, X) relative to the bending station, so that the gripper (2) is able to be moved along any of said two directions (A, X) to grip said bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, wherein said gripper supporting structure (5) is movable also in a third direction which is perpendicular to a working plane (21) of said bending station, and wherein the wrist member (3) of each gripper (2) is pivotally mounted around said articulation axis (4) on a structure which is pivotally supported by said gripper supporting structure (5) around an axis parallel to said third direction, wherein sensor means are associated with said gripper to sense positions along the bars where the bars can be gripped.

17. An installation for processing metal bars for concrete reinforcement, comprising:

first transferring means for transferring said bars (B) from a first station (20) which receives bars which are to be subjected to a bending operation in said installation to a bending station, comprising bending units (22), and second means for transferring said bars (B) from said bending station, once the bars have been bent therein, to a third unloading station (28), in which said first transferring means comprise:

a supporting frame (13) in the installation, grippers (2), each including:

a gripper supporting structure (5) guided on said supporting frame, so as to be movable in the installation, relative to the bending station, at least along a first direction (A) which is horizontal and parallel to a longitudinal direction of the bars in the installation, and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of the grippers (2) are mounted on a wrist member (3) which on its turn is pivotally mounted on said gripper supporting structure (5) around a substantially horizontal axis of articulation (4), and wherein controlling means are provided for controlling the rotation of said wrist member of each gripper about said axis of articulation (4) so as to be capable of orienting said gripper (2) in any angular position around said axis of articulation (4) relative to the gripper supporting structure, while the gripper supporting structure is able to be moved along any of said longitudinal and transverse directions (A, X) relative to the bending station, so that the gripper (2) is able to be moved along any of said two directions (A, X) to grip one or more bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, wherein the bending station comprises two bending units (22) spaced apart from each other and aligned in the longitudinal direction (A) of the bars (B), as well as a plurality of tables which are movable between a raised operative position where they define a support plane for the bars in the space along the longitudinal direction (A) between the two bending units or also longitudinally outside of said space, and a lowered inoperative position, where they do not interfere with the movement of the bending units in the longitudinal direction.

18. An installation for processing metal bars for concrete reinforcement, comprising:

first transferring means for transferring said bars (B) from a first station (20) which receives bars which are to be subjected to a bending operation in said installation to a bending station, comprising bending units (22), and second means for transferring said bars (B) from said bending station, once the bars have been bent therein, to a third unloading station (28), in which said first transferring means comprise:

a supporting frame (13) in the installation, grippers (2), each including:

a gripper supporting structure (5) guided on said supporting frame, so as to be movable in the installation, relative to the bending station, at least along a first direction (A) which is horizontal and parallel to a longitudinal direction of the bars in the installation, and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of the gripper (2) are mounted on a wrist member (3) which is pivotally mounted on said gripper supporting structure (5) around a substantially horizontal axis of articulation (4), and wherein controlling means are provided for controlling the rotation of said wrist member of each gripper about said axis of articulation (4) so as to be capable of orienting said gripper (2) in any angular position around said axis of articulation (4) relative to the gripper supporting structure, while the gripper supporting structure is able to be moved along any of said longitudinal and transverse directions (A, X) relative to the bending station, so that the gripper (2) is able to be moved along any of said two directions (A, X) to grip one or more bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, wherein an auxiliary support is associated to a bending unit (22) said auxiliary support being movable between an inoperative retracted position and an operative position in which the auxiliary support surmounts at least partially a revolving disk of the bending unit, in such a way that, in a cycle of bending operations necessary to obtain a closed loop stirrup of quadrangular shape starting from a rectilinear bar, it is assured, in the final phase of the bending cycle, that the end portions of the bar constituting each stirrup are mutually approached without risk of interference between the bar portions in motion and a central mandrel of the bending unit and/or the opposite ends of the bars.

19. An installation for processing metal bars for concrete reinforcement, comprising:

first means for transferring the bars (B) from a first station (20) which receives bars which are to be subjected to a bending operation in said installation to a bending station, comprising a bending unit (22), and second means for transferring bars (B) from said bending station, once the bars have been bent therein, to a third unloading station (28), wherein said first means for transferring comprise:

a supporting frame (13) in the installation, a gripper (2), including:

a gripper supporting structure (5) guided on said supporting frame, so as to be movable in the installation, relative to the bending station along a first direction (A) which is horizontal and parallel to a longitudinal direction of the bars in the installation and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which in turn is pivotally mounted on said gripper supporting structure (5) around a substantially horizontal axis of articulation (4), and wherein means are provided for controlling the rotation of said wrist member of each gripper about said axis of articulation (4) so as to be capable of orienting said gripper (2) in an angular position around said axis of articulation (4) relative to the gripper supporting structure, while the gripper supporting structure is movable along said longitudinal and transverse directions (A, X) relative to the bending station, wherein the gripper (2) is able to be moved along any of said two directions (A, X) to grip the bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, and wherein the same grippers (2) are arranged so that they can be used both as the first means for transferring the bars (B) from the first station (20) to the bending station and as the second means for transferring the bars (B) from said bending station to the third unloading station (28), and in which the bending unit (22) comprises a revolving disk for supporting the bars to be bent, with a central axial mandrel (23) about which the bars are bent and an eccentric bending pin (24) for bending the bars about the mandrel, as well as an abutment element (25) against which the bars bear laterally during the bending operation, said central mandrel (23) and said abutment element (25) defining between them a gap for receiving the bars to be bent, arranged side by side to each other in a plane substantially perpendicular to the plane of the bending disc (21), wherein the bending unit comprises adjustment means for adjusting the distance between the mandrel (23) and a butting organ (25) in a direction transverse to the longitudinal direction (A) and control means for commanding said adjustment means to adjust automatically the width of the space for receiving the bars as a function of the diameter of the bars.

20. A method for transferring a plurality of bars (B) in an installation for processing metal bars for concrete reinforcement, in which said installation comprises first transferring means for transferring bars (B) from a first station (20) which receives bars which are to be subjected to a bending operation in said installation to a bending station, comprising bending units (22), and second means for transferring bars (B) from said bending station, once the bars have been bent therein, to a third unloading station (28), in which said first transferring means comprise:

a supporting frame (13) in the installation, grippers (2), each including:

a gripper supporting structure (5) guided on said supporting frame, so as to be movable in the installation, relative to the bending station, at least along a first direction (A) which is horizontal and parallel to a longitudinal direction of the bars in the installation, and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which on its turn is pivotally mounted on said gripper supporting structure (5) around a substantially horizontal axis of articulation (4), wherein the rotation of said wrist member of each gripper about said axis of articulation (4) is controlled for orienting said gripper (2) in any angular position around said axis of articulation (4) relative to the gripper supporting structure, while the gripper supporting structure is movable along any of said longitudinal and transverse directions (A, X) relative to the bending station, and wherein said first transferring means are controlled in such a way as to grip the bars (B) at said first station (20), which are arranged substantially side by side in a first plane having a first orientation, and to deposit said bars at said bending station, arranged substantially side by side in a second plane having a second orientation which can be different from said first orientation, wherein the bent bars are gripped in proximity to the projection of their centre of gravity along the transverse direction (X) and/or the longitudinal direction (A).

21. A method for transferring a plurality of bars (B) in an installation for processing metal bars for concrete reinforcement, in which said installation comprises first transferring means for transferring bars (B) from a first station (20) which receives bars which are to be subjected to a bending operation in said installation to a bending station, comprising bending units (22), and second means for transferring bars (B) from said bending station, once the bars have been bent therein, to a third unloading station (28), in which said first transferring means comprise:

a supporting frame (13) in the installation, grippers (2), each including:

a gripper supporting structure (5) guided on said supporting frame, so as to be movable in the installation, relative to the bending station, at least along a first direction (A) which is horizontal and parallel to a longitudinal direction of the bars in the installation, and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which on its turn is pivotally mounted on said gripper supporting structure (5) around a substantially horizontal axis of articulation (4), wherein the rotation of said wrist member of each gripper about said axis of articulation (4) is controlled for orienting said gripper (2) in any angular position around said axis of articulation (4) relative to the gripper supporting structure, while the gripper supporting structure is movable along any of said longitudinal and transverse directions (A, X) relative to the bending station, and wherein said first transferring means are controlled in such a way as to grip the bars (B) at said first station (20), which are arranged substantially side by side in a first plane having a first orientation, and to deposit said bars at said bending station, arranged substantially side by side in a second plane having a second orientation which can be different from said first orientation, wherein controlling means are provided for controlling the grippers which are programmable to calculate the position of the centre of gravity of the bars.

22. A method for transferring a plurality of bars (B) in an installation for processing metal bars for concrete reinforcement, in which said installation comprises first transferring means for transferring bars (B) from a first station (20) which receives bars which are to be subjected to a bending operation in said installation to a bending station, comprising bending units (22), and second means for transferring bars (B) from said bending station, once the bars have been bent therein, to a third unloading station (28), in which said first transferring means comprise:

a supporting frame (13) in the installation, grippers (2), each including:

a gripper supporting structure (5) guided on said supporting frame, so as to be movable in the installation, relative to the bending station, at least along a first direction (A) which is horizontal and parallel to a longitudinal direction of the bars in the installation, and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which on its turn is pivotally mounted on said gripper supporting structure (5) around a substantially horizontal axis of articulation (4), wherein the rotation of said wrist member of each gripper about said axis of articulation (4) is controlled for orienting said gripper (2) in any angular position around said axis of articulation (4) relative to the gripper supporting structure, while the gripper supporting structure is movable along any of said longitudinal and transverse directions (A, X) relative to the bending station, and wherein said first transferring means are controlled in such a way as to grip the bars (B) at said first station (20), which are arranged substantially side by side in a first plane having a first orientation, and to deposit said bars at said bending station, arranged substantially side by side in a second plane having a second orientation which can be different from said first orientation, wherein points at which the bars are gripped in the first station are calculated as a function of parameters unloading weight distribution, length and diameter of the bars.

23. A method as claimed in claim 22, wherein when unloading the bent bars from the bending station, the distance along the longitudinal direction (A) between grippers (2) and mandrels (23) of the bending units is calculated as a function of parameters including bar diameter, bar length, and length of the overhanging segment beyond the closest gripper.

24. A method for transferring a plurality of bars (B) in an installation for processing metal bars for concrete reinforcement, in which said installation comprises first transferring means for transferring bars (B) from a first station (20) which receives bars which are to be subjected to a bending operation in said installation to a bending station, comprising bending units (22), and second means for transferring bars (B) from said bending station, once the bars have been bent therein, to a third unloading station (28), in which said first transferring means comprise:

a supporting frame (13) in the installation, grippers (2), each including:

a gripper supporting structure (5) guided on said supporting frame, so as to be movable in the installation, relative to the bending station, at least along a first direction (A) which is horizontal and parallel to a longitudinal direction of the bars in the installation, and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which on its turn is pivotally mounted on said gripper supporting structure (5) around a substantially horizontal axis of articulation (4), wherein the rotation of said wrist member of each gripper about said axis of articulation (4) is controlled for orienting said gripper (2) in any angular position around said axis of articulation (4) relative to the gripper supporting structure, while the gripper supporting structure is movable along any of said longitudinal and transverse directions (A, X) relative to the bending station, and wherein said first transferring means are controlled in such a way as to grip the bars (B) at said first station (20), which are arranged substantially side by side in a first plane having a first orientation, and to deposit said bars at said bending station, arranged substantially side by side in a second plane having a second orientation which can be different from said first orientation, wherein programmable means are provided for controlling the motion of the grippers (2), which control the velocity of motion as a function of parameters including bar diameter, length of the tail segment of the bar positioned beyond the closest gripper, weight of the bars, shape of the bar (in the case of bent bars), and number of the bars.

25. An installation for processing metal bars for concrete reinforcement, comprising:

first means for transferring the bars (B) from a first station (20) which receives bars which are to be subjected to a bending operation in said installation to a bending station, comprising bending units (22), and second means for transferring bars (B) from said bending station, once the bars have been bent therein, to a third unloading station (28), wherein said first means for transferring comprise:

a supporting frame (13) in the installation, grippers (2), each including:

a gripper supporting structure (5) guided on said supporting frame, so as to be movable in the installation, relative to the bending station along a first direction (A) which is horizontal and parallel to a longitudinal direction of the bars in the installation and along a second direction (X) which is horizontal and perpendicular to the longitudinal direction (A) of the bars, and a pair of jaws (2*a*) mounted on said gripper supporting structure (5) and movable between an opened condition and a closed condition, wherein said pair of jaws (2*a*) of each gripper (2) are mounted on a wrist member (3) which on its turn is pivotally mounted on said gripper supporting structure (5) around a substantially horizontal axis of articulation (4), and in that wherein means are provided for controlling the rotation of said wrist member of each gripper about said axis of articulation (4) so as to be capable of orienting said gripper (2) in any angular position around said axis of articulation (4) relative to the gripper supporting structure, while the gripper supporting structure is movable along any of said longitudinal and transverse directions (A, X) relative to the bending station, wherein the gripper (2) is able to be moved along any of said two directions (A, X) to grip the bars (B) at said first station (20), keeping them substantially side by side with respect to each other in a plane having a first orientation, and to deposit said bars (B) at said bending station always keeping them substantially side by side with respect to each other in a plane having a second orientation which can be different from said first orientation, wherein said gripper supporting structure (5) is movable also in a third direction which is perpendicular to a working plane (21) of said bending station, said third direction being inclined both to the vertical and the horizontal, wherein the movable support structure is mounted on a carriage which is movable along an overhead cross member structure which in turn is movable in the manner of an overhead traveling crane on overhead beams of a frame which overlies the installation, said overhead beams extending parallel to the working plane of said bending station.

* * * * *